US009248469B2

(12) United States Patent
Spreck et al.

(10) Patent No.: US 9,248,469 B2
(45) Date of Patent: Feb. 2, 2016

(54) CLOSURE SEAL

(71) Applicant: Advanced Web Technologies, LLC, Minneapolis, MN (US)

(72) Inventors: Andrew John Spreck, Stacy, MN (US); Todd Owen Schneider, Coon Rapids, MN (US); Trevor Klungseth, Ham Lake, MN (US); Michelle Zeller, Minneapolis, MN (US); Duane Jason Huberty, Oakdale, MN (US); Kevin Todd Barker, Coon Rapids, MN (US)

(73) Assignee: BOSTON SCIENTIFIC SCIMED, INC., Maple Grove, MN (US)

( * ) Notice: Subject to any disclaimer, the term of this patent is extended or adjusted under 35 U.S.C. 154(b) by 0 days.

(21) Appl. No.: 13/928,499

(22) Filed: Jun. 27, 2013

(65) Prior Publication Data

US 2015/0001223 A1 Jan. 1, 2015

(51) Int. Cl.

| | |
|---|---|
| ***G09F 3/10*** | (2006.01) |
| ***B05D 3/12*** | (2006.01) |
| ***B31D 1/00*** | (2006.01) |
| ***B31D 1/02*** | (2006.01) |

(52) U.S. Cl.

CPC ..... *B05D 3/12* (2013.01); *B31D 1/0018* (2013.01); *B31D 1/021* (2013.01); *G09F 3/10* (2013.01); *B65D 2101/0007* (2013.01)

(58) Field of Classification Search

USPC ..... 40/638; 428/42.3

See application file for complete search history.

(56) References Cited

U.S. PATENT DOCUMENTS

| | | | | |
|---|---|---|---|---|
| 2,013,299 | A | 1/1935 | Byrne | |
| 4,192,420 | A | 3/1980 | Worrell, Sr. et al. | |
| 4,258,876 | A | 3/1981 | Ljungcrantz | |
| 4,309,468 | A | 1/1982 | St. Aubin | |
| 4,386,705 | A | 6/1983 | Meuller | |
| 4,386,925 | A | 6/1983 | Focke | |
| 4,514,248 | A * | 4/1985 | Cummings | 156/268 |
| 4,679,693 | A | 7/1987 | Forman | |

(Continued)

FOREIGN PATENT DOCUMENTS

| | | | |
|---|---|---|---|
| EP | 0669204 | A1 | 8/1995 |
| JP | 2001072045 | A | 3/2001 |

(Continued)

*Primary Examiner* — Joanne Silbermann

(74) *Attorney, Agent, or Firm* — Seager, Tufte & Wickhem, LLC

(57) ABSTRACT

A closure seal or tamper evident pressure sensitive label of a sandwich construction for use at the opening seam of packaging to be sealed to indicate whether the package has been opened or otherwise tampered with. The label includes a facer material, a liner material and a pressure sensitive adhesive therebetween. The facer material has cut out a lower label section joined to an upper pull tab section with adjacent tab wings. The upper pull tab section has a liner material portion cut out to adhere to a back or under side of the upper tab section upon pulling the label off the liner material for use. The lower label section and wings has exposed adhesive upon the label being pulled off the liner material for use. Once the label is placed on the packaging, the lower label section and the upper pull tab with adjacent tab wings are aligned to straddle the opening seam of the packaging. The tab maybe pulled away from the label and torn away from the wings while remaining intact with the lower label section to evidence the package has been opened or otherwise tampered with. The label is manufactured by a flexo-graphic web method.

20 Claims, 5 Drawing Sheets

(56) References Cited

U.S. PATENT DOCUMENTS

| | | | |
|---|---|---|---|
| 4,837,061 | A | 6/1989 | Smits et al. |
| 5,082,702 | A | 1/1992 | Alband |
| 5,727,819 | A | 3/1998 | Grosskopf et al. |
| 5,893,587 | A | 4/1999 | Wong |
| 5,908,246 | A | 6/1999 | Arimura et al. |
| 5,944,355 | A | 8/1999 | Rich et al. |
| 6,149,203 | A | 11/2000 | Hanlon |
| 6,303,202 | B1 | 10/2001 | Washburn et al. |
| 6,343,695 | B1 | 2/2002 | Petrick et al. |
| 6,398,028 | B1 | 6/2002 | Stovall |
| 6,413,605 | B1 | 7/2002 | Hoffer |
| 6,499,241 | B1 | 12/2002 | Vila-Martinez |
| 6,508,904 | B1 | 1/2003 | Charley |
| 6,589,622 | B1 | 7/2003 | Scott |
| 6,767,604 | B2 | 7/2004 | Muir, Jr. et al. |
| 7,934,616 | B2 | 5/2011 | Felber |
| 8,187,688 | B2 | 5/2012 | MacWilliams |
| 8,273,433 | B2 | 9/2012 | Flynn |
| 8,308,363 | B2 | 11/2012 | Vogt et al. |
| 2002/0023924 | A1 | 2/2002 | Wisniewski et al. |
| 2004/0060892 | A1 | 4/2004 | Heston et al. |
| 2004/0112010 | A1 | 6/2004 | Richards et al. |
| 2005/0167026 | A1 | 8/2005 | Dronzek et al. |
| 2005/0230958 | A1 | 10/2005 | Payne et al. |
| 2005/0230961 | A1 | 10/2005 | Walley |
| 2007/0024050 | A1 | 2/2007 | White et al. |
| 2007/0104915 | A1 | 5/2007 | Blancato et al. |
| 2008/0257673 | A1 | 10/2008 | Mrocki et al. |
| 2009/0091121 | A1 | 4/2009 | Urbanek |
| 2010/0154264 | A1* | 6/2010 | Scott et al. ..... 40/630 |
| 2011/0171411 | A1 | 7/2011 | Jordan |
| 2012/0021188 | A1 | 1/2012 | White et al. |
| 2014/0217163 | A1 | 8/2014 | Marshall et al. |

FOREIGN PATENT DOCUMENTS

| | | | |
|---|---|---|---|
| JP | 2009086043 | A | 4/2009 |
| JP | 2011170222 | A | 9/2011 |

* cited by examiner

CLOSURE SEAL

BACKGROUND OF THE INVENTION

The present invention is directed to a closure seal, and more particularly, to a closure seal that remains on the sealed packaging and does not result in a loose residual piece or substrate after tearing and releasing the underlying container or package so that it may be opened.

There are currently a number of closure seal structures that undergo an irreversible and readily observable change when the structures are peeled apart, separated or removed from an item on which they have placed. Closure seals are commonly used on packaged sterilized medical products, pharmaceuticals and often used in sterile environments like operating rooms, surgical facilities, pharmaceutical applications, veterinary surgical facilities, high-tech assembly operations, dental offices and other highly controlled environments.

Such tear off type closure seals result in a loose strip to be disposed of separately from the product packaging. Such loose strips pose a problem in sterile environments as they pose additional demands on personnel and facilities in their proper and safe disposal.

There is a need for a closure seal that remains intact with the packaging and does not require separate disposal consideration while yet providing easy visual recognition as to the security of the contents of the underlying container or package.

SUMMARY OF THE INVENTION

A closure seal or tamper evident pressure sensitive label of a sandwich construction for use at the opening seam of packaging to be sealed to indicate whether the package has been opened or otherwise tampered with. The label includes a facer material, a liner material and a pressure sensitive adhesive therebetween. The facer material has cut out a lower label section joined to an upper pull tab section with adjacent tab wings. The upper pull tab section has a liner material portion cut out to adhere to a back or under side of the upper tab section upon pulling the label off the liner material for use. The lower label section and wings has exposed adhesive upon the label being pulled off the liner material for use. Once the label is placed on the packaging, the lower label section and the upper pull tab with adjacent tab wings are aligned to straddle the opening seam of the packaging. The tab maybe pulled away from the label and torn away from the wings while remaining intact with the lower label section to evidence the package has been opened or otherwise tampered with. The label is manufactured by a flexo-graphic web method.

A principal object and advantage of the present label invention is that it provides easy visual recognition as to the security of the contents of the underlying container or package while yet remains intact with the packaging and does not require separate disposal consideration.

Another object and advantage of the present label invention is that it is made of a simple 2 ply sandwich construction with pressure sensitive adhesive between the facer and liner layers.

Another object and advantage of the present label invention is that it is economically manufactured by a novel flexo-graphic web method with specific die characteristics relative to the stagger of various label products, eye specific graphic indications, shape and undercutting of the label previously unknown.

Another object and advantage of the present label invention is that it can be changed, increased in size and shape to accomplish different closure seal applications without losing the core benefits that it provides.

Another object and advantage of the present label invention is that it can be manufactured using a wide variety of substrates.

Another object and advantage of the present label invention is that it can be used universally on many different packaging options, envelopes and including food and food preparations, with consistent benefits.

Another object and advantage of the present label invention is that its unique shape lends itself to easy tearing and releasing the underlying container even with a gloved hand.

Another object and advantage of the present label invention is the closure seal label is easy to apply using manual, semi-automatic and automatic methods.

Another object and advantage of the present label invention includes indents and graphical indications to guide proper placement on the container and proper tear tab gripping.

Another object and advantage of the present label invention is that the label employs an aggressive adhesive which ensures bonding integrity on many packaging finishes.

Another object and advantage of the present label invention is that the pull tab remains attached to the label after opening and thus does not need to be disposed of which provides a unique safety feature for highly controlled environments.

Another object and advantage of the present label invention is the capability to laterally stagger labels on a wide web for high volume production and to minimize wear on the dies.

Another object and advantage of the present label invention is to provide undercutting of a liner portion on the backside or underside of the tear pull tab section to facilitate easy, smooth and straight tearing of the tab section away from the adhesively held adjacent tab wings while remaining intact with the lower label section.

DETAILED SPECIFICATION

Figure 1:
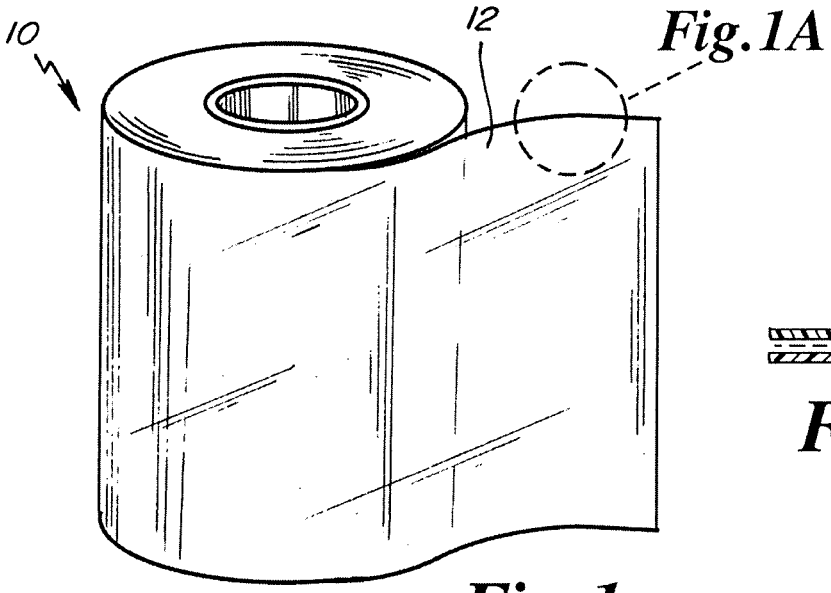
FIG. 1 is a perspective view of a pressure sensitive roll stock or material roll form.

Referring to FIGS. 1 through 8, the closure seal pressure sensitive label 54 of a sandwich construction for use at the opening seam of packaging to be sealed to indicate whether the package has been opened or otherwise tampered with may be seen and generally understood. The label 54 includes a facer material 12, a liner material 14 and a pressure sensitive adhesive 16 therebetween. The facer material 12 has cut out a lower label section 72 joined to an upper pull tear tab section 65 with adjacent tab wings 67. The upper pull tab section 65 has a liner material portion 62 cut out to adhere to a back or under side of the upper tab section 65.

Figure 1A:
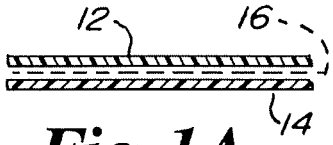
FIG. 1A is an enlarged top edge view of the label material taken from the circle 1A of FIG. 1.

More specifically referring to FIGS. 1 and 1A, the closure seal label 54 is made from pressure sensitive material 10 in roll form. The material 10 is of a sandwich construction comprising a white polypropylene facer 12, a clear polyester liner 14 and an aggressive pressure sensitive adhesive 16 therebetween that will ensure bonding integrity. The roll 10 may have various widths. Illustratively here, the roll material 10 may be approximately a foot wide to accommodate laterally staggered six labels 54. Other materials and substrates will also work well in constructing closure seal labels of the present invention.

Figure 2:
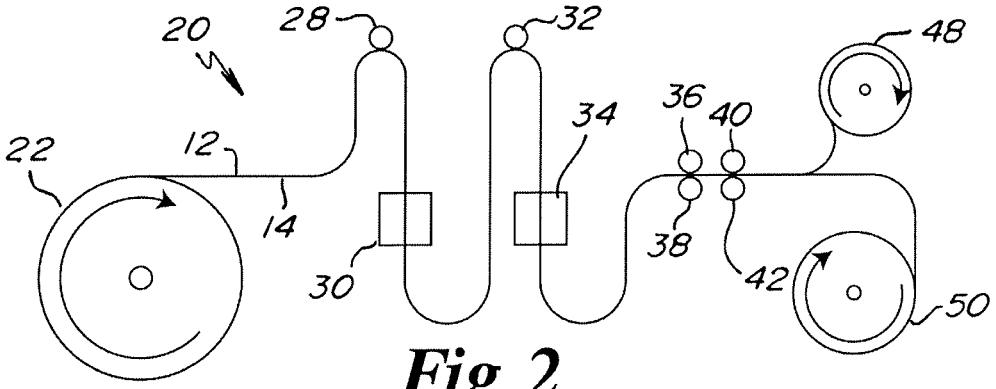
FIG. 2 is a line drawing of the flexo-graphic web method of forming an array of laterally staggered closure seal labels.

One method of forming labels 54 is shown in FIG. 2. The flexo-graphic web method includes a web assembly line 20 that begins with continuously feeding the material roll form 10 from a roller. The web of material 10 has a white polypropylene facer 12, a clear polyester liner 14 and a pressure sensitive adhesive 16 therebetween. This material is a sandwich design. The web or material 10 is fed into a flexo print station 28 where the base color of the label 54 is applied and cured at the UV cure unit 30. From there the web is continuously fed into a second flexo print station 32 for application of graphical indications and any other desired printing and then cured at the second UV cure unit 34.

Next the continuously feeding web of material 10 is die cut. On top of the material 10 is anvil roll or roller 36 while immediately below and touching the liner 14 is undercut rotary die 38. This combination creates liner cut out portion 62 which is to adhere to the underside 70 of pull tear tab 65 it also lineally trims the roll material web 10. The web 10 continues onto the top cut rotary die 40 with second anvil roll 42 therebelow. This step cuts out the label 54 from the facer material 10 but is still adhered to the liner 14. Thereafter the waste matrix of the facer material is removed and taken up off the liner 14 onto a roll 48. The moving finished web 10 of labels 54 on liner 14 is taken up onto a finished roll 50.

Figure 3:
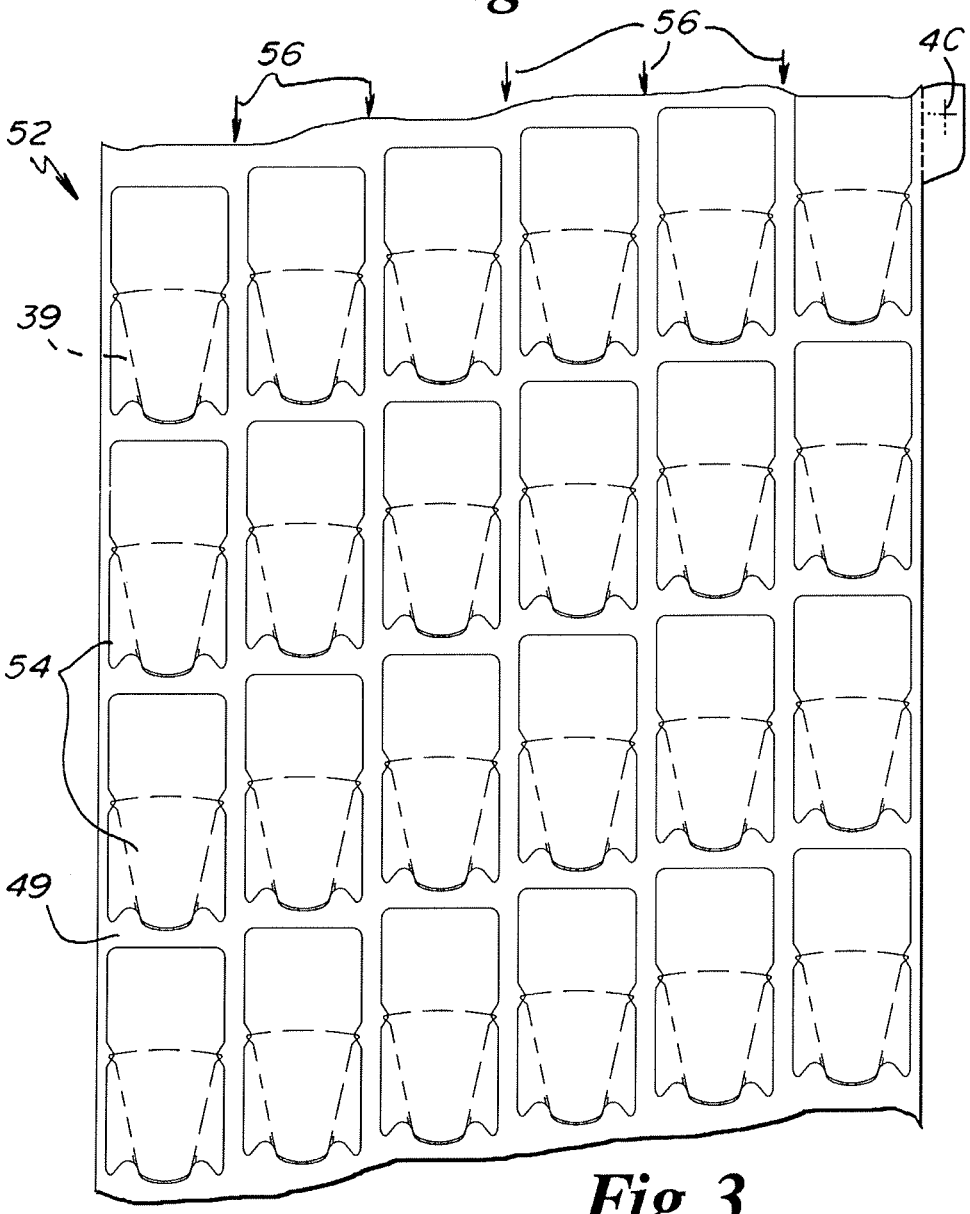
FIG. 3 is a top plan view of an array of laterally staggered closure seal labels.

Labels 54 maybe an inline singular arrangement or a laterally staggered multi-label arrangement, as shown in FIG. 3, however desired for end use. Linear die trimming may be at arrows 56. The finished multi-label roll 52 has individual labels 54 on the clear liner 49 after the waste matrix 48 has been removed. In phantom the liner cut out portion 62 may be seen on the underside of the pull tear tab 65. The upper right of FIG. 3 shows the rotary die alignment cross 40 which show a perfect intersection when the dies are perfectly aligned.

Figure 4:
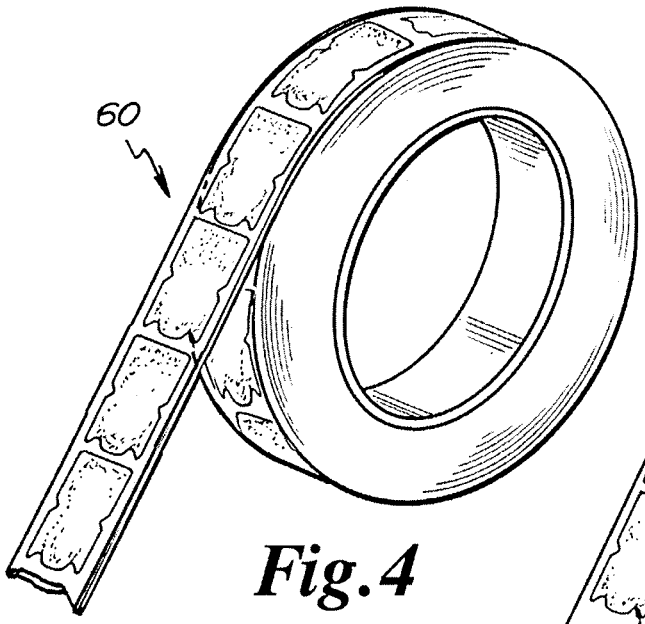
FIG. 4 is a perspective view of a single roll of inline labels.
Figure 5:
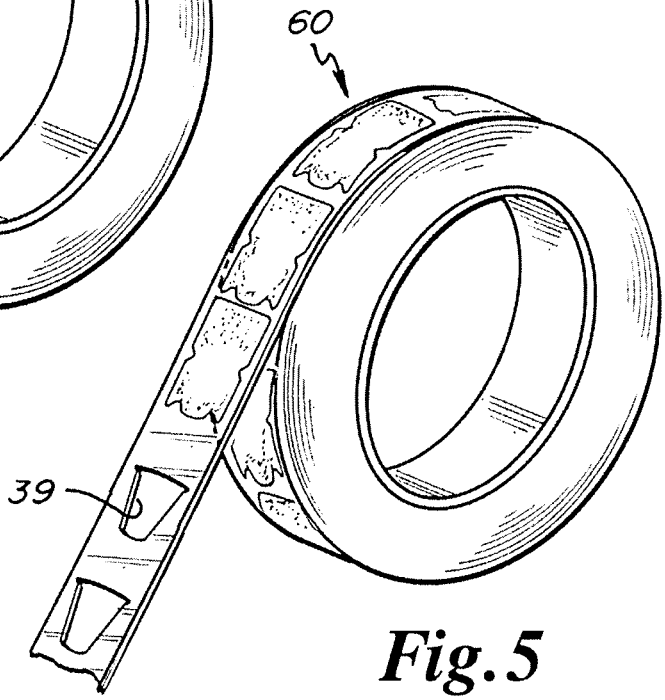
FIG. 5 is a perspective view of the single roll of inline labels similar to FIG. 1 with two label removed showing the liner cut portion.

FIG. 4 shows an inline label roll 60 which may be used for hand application, a dispenser, a hand applicator or automated with package loading. FIG. 5 show the single inline roll with a couple of labels 54 removed showing the liner undercut outline 39.

Figure 6:
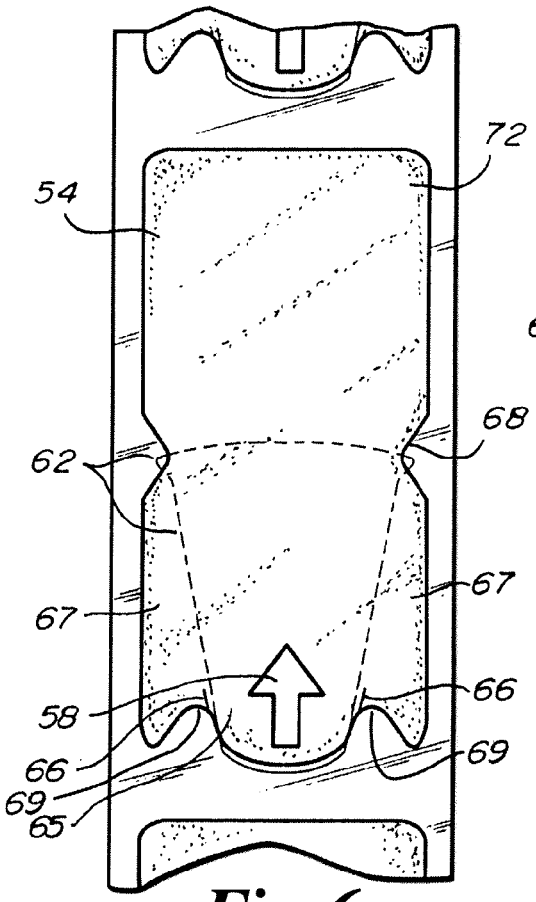
FIG. 6 is a top plan view of the invention label on a section of the liner from FIG. 4 broken away.
Figure 8:
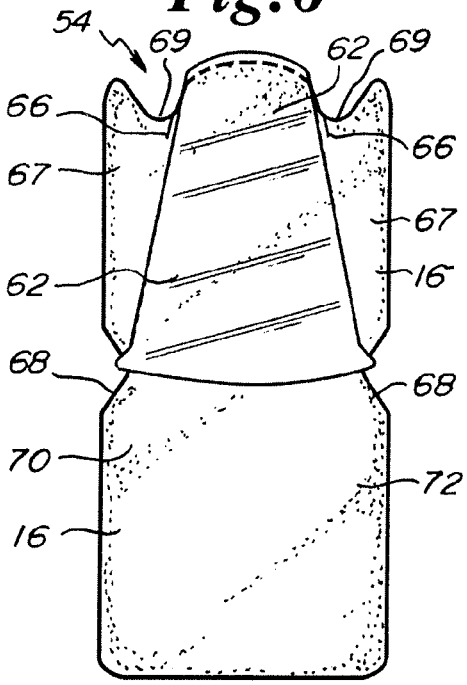
FIG. 8 is a bottom plan view of the label with the cut out portion of the liner adhered to the underside of the pull tear tab.
Figure 7:
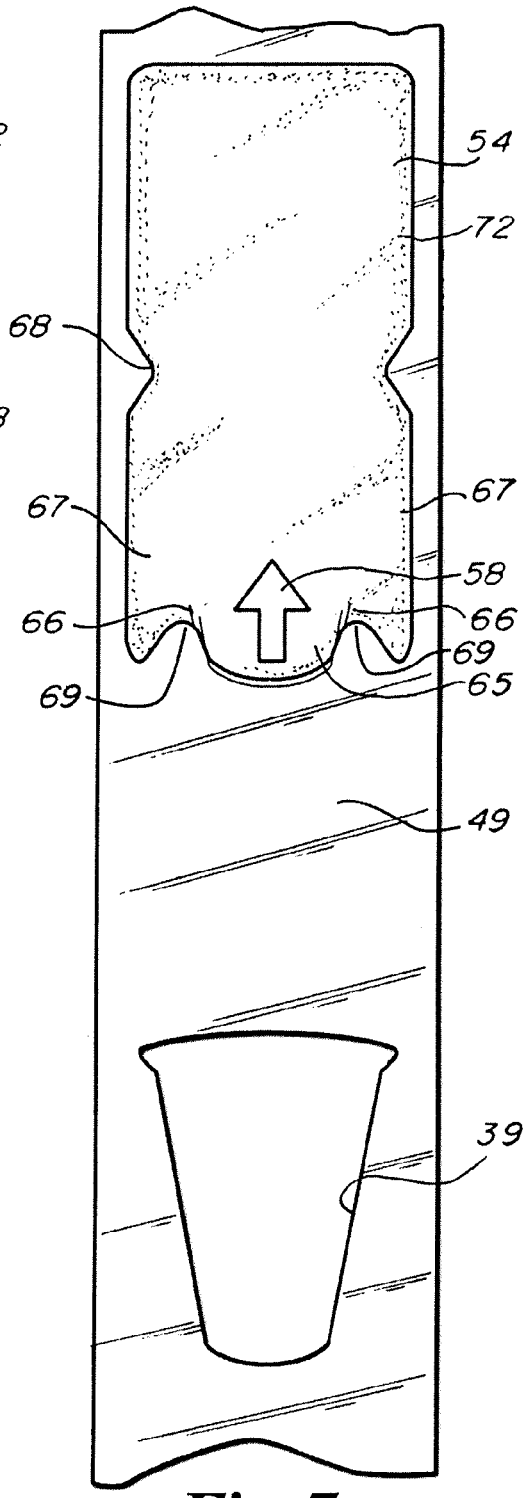
FIG. 7 is a top plan view of the invention label on a section of the liner from FIG. 5 broken away and showing the liner cut portion.

FIGS. 6 through 8 show the details of the label 54 and the exposed roll liner 49 therebelow. After the label base color is applied and cured, graphic indications like arrow 58 is printed thereon. The arrow 58 is at the top of the tear pull tab 65 to indicate where to grip and pull to open the seal and release the packaging seam from the closure constraint.

The underside 70 of tab portion 65 has the liner portion 62 which is removed from liner 14 at cutout 39. Tab portion 65 will not adhere to packaging. Adjacent to tab 65 are label wings 67 which will adhere to a package as the adhesive 16 stays on the underside of the wings 67 and not on the liner 14. Tab indents 69 are for emphasis in locating tab 65 for gripping as well as for shielding tab 65 from unintentional opening by contact with some other object before intended opening by end user. Tear starter slits 66 will assist in the beginning of tearing the tab 65 away from wings 67 for indicating or evidencing a tamper or opening of the applicable package.

Figure 9:
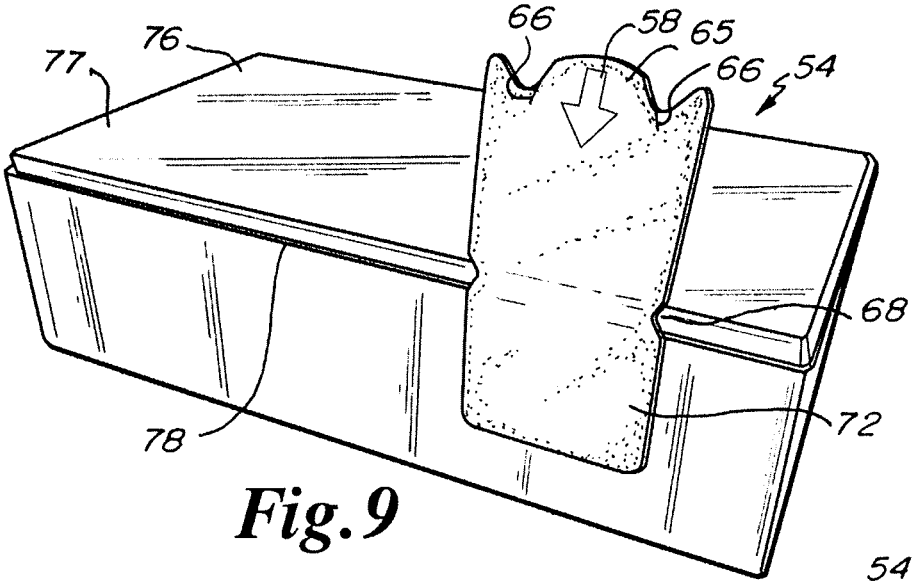
FIG. 9 is a front perspective view of a container or package with a lid and an opening seam with the lower label section adhered to the sidewall of the container and the label indents and rectangle indication straddling the closed opening seam.
Figure 10:
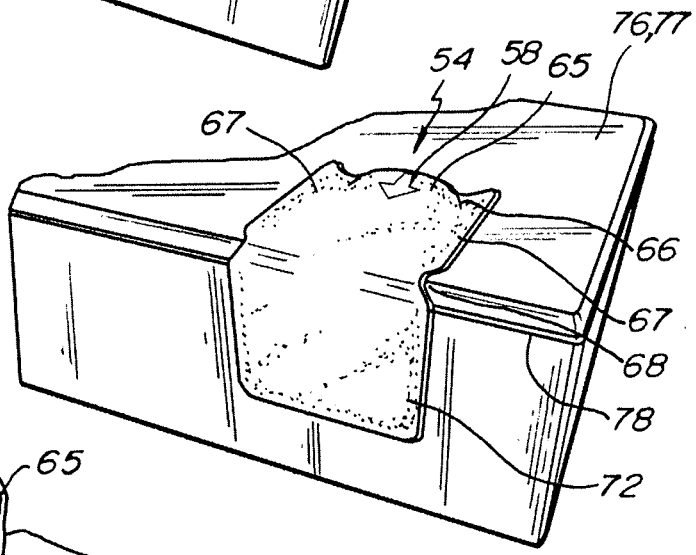
FIG. 10 is a front perspective view of the container or package with a lid and an opening seam with the lower label section adhered to the sidewall of the container, the label indents and rectangle indication straddling the closed opening seam and the tear pull tab secured to the lid by way of the adhesive on the tab wings.
Figure 11:
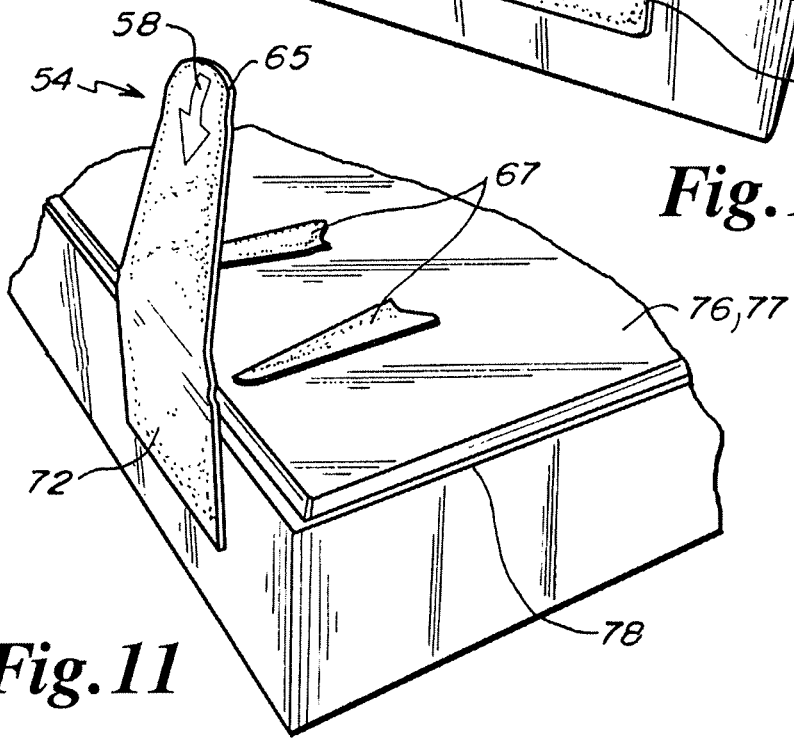
FIG. 11 is a front perspective view of the container or package with the lid and opening seam with the lower label section adhered to the sidewall of the container, the label indents and rectangle indication straddling the closed opening seam and the tear pull tab pulled away from the tab wings exposing the lid opening seam evidencing that the container is not secure.
Figure 12:
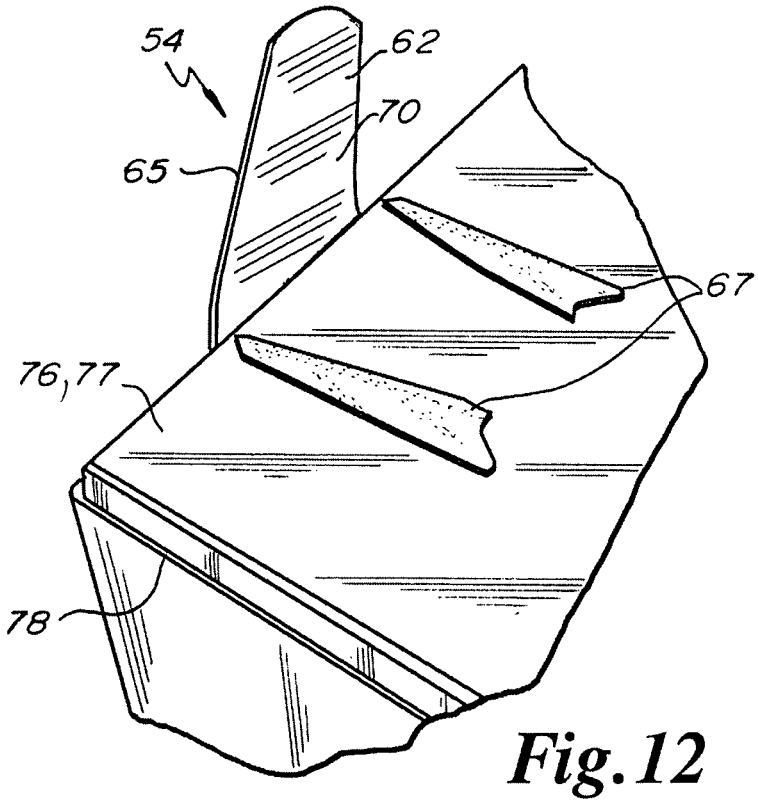
FIG. 12 is a rear perspective view of the container or package with the lid and opening seam with the lower label section adhered to the sidewall of the container and the tear pull tab with its non-adhesive underside with the exposed liner portion pulled away from the tab wings exposing the lid opening seam evidencing that the container is not secure.
Figure 13:
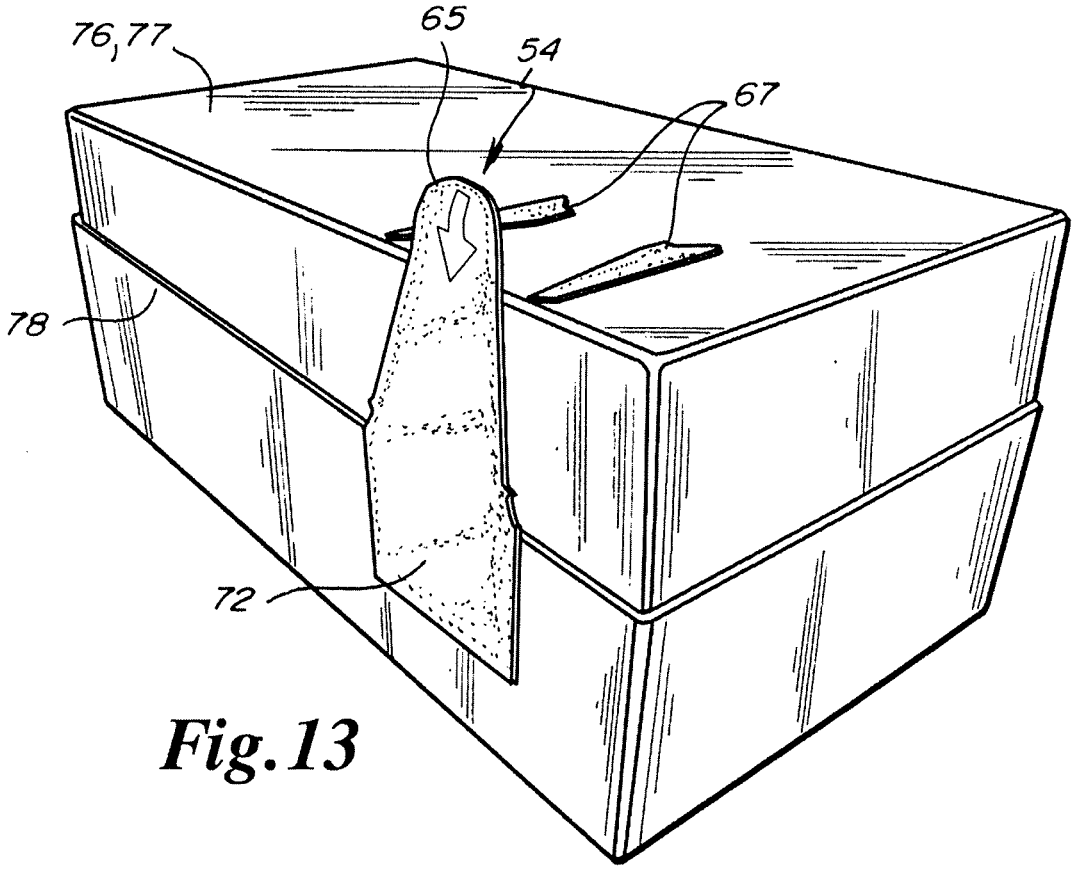
FIG. 13 is a front perspective view of the container or package with the lid and opening seam with the lower label section adhered to the sidewall of the container, the label indents and rectangle indication straddling the closed opening seam and the tear pull tab pulled away from the tab wings exposing the lid opening seam with the lid partially removed further evidencing that the container is not secure.

FIGS. 9 and 10 show the application of the closure seal label 54 on a container 76, box, package or envelope with a lid top 77 or closing flap having an opening seam 78. The label is separated from the liner 49. The label's indents are aligned over the opening seam 78 and the lower label section 72 is pressed against the sidewall of the container 76. Next the tear pull tab 65 and wings 67 are pressed against the container lid 77 as to adhere the wings to the packaging. Multiple such labels 54 may be used if needed.

FIGS. 10 through 13 illustrate how the seal of the label 54 is broken. The tab 65 in the vicinity of the arrow 58 between indents 69 is suitably grasps by the fore finger and thumb and lifted up and away from the adhered wings 67. The label tear starter slits 66 and the non-adhesive nature of the tab's underside 62 assist in this peeling away of the tab 65 from the wings 67.

It is readily visible that the label 54 has been torn away with the wings 67 only remaining on the container 76 and the tab 65 pointing upward. After this condition, the lid or top 77 may be opened at the seam 78.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A closure seal pressure sensitive label of a sandwich construction for use at the opening seam of packaging to be sealed to indicate whether the package has been opened or otherwise tampered with, comprising:

a) a facer material, a liner material and a pressure sensitive adhesive therebetween;

b) the facer material having cut out a lower label section joined to an upper pull tab section with adjacent tab wings;

c) the upper pull tab section has a liner material portion cut out to adhere to a back side of the upper pull tab section upon pulling the label off the liner material for use; and d) the lower label section and the adjacent tab wings have exposed adhesive upon the label being pulled off the liner material for use, wherein once the label is on the packaging the upper pull tab section may be pulled away from the packaging and torn away from the tab wings while remaining intact with the lower label section to indicate the package has been opened or otherwise tampered with;

wherein the label exists on a roll of material as one of a plurality of labels laterally staggered across a width of the roll.

2. The closure seal of claim 1, wherein the facer material comprises white polypropylene and the liner material comprises clear polyester.

3. The closure seal of claim 1, wherein between the upper pull tab section and the tab wings are slits to assist in the beginning of the upper pull tab section tearing away from the tab wings which remain on the packaging and the upper pull tab section remains intact with the lower label section.

4. The closure seal of claim 1, wherein the facer material has graphical indications to guide proper tearing of the upper pull tab section and label placement during application to the packaging.

5. The closure seal of claim 1, wherein label indents are in the label between the upper pull tab section and the lower label section.

6. The closure seal of claim 1, wherein tab indents are between the top of the upper pull tab section and the adjacent tab wings for easy identifiable grasping of the upper pull tab section as well as for protection from incidental unintended opening prior to end user interaction.

7. The closure seal of claim 1, wherein the roll of material is a roll of facer material, liner material and adhesive therebetween.

8. A closure seal pressure sensitive label of a sandwich construction for use at the opening seam of packaging to be sealed to indicate whether the package has been opened or otherwise tampered with, comprising:

a) a facer material, a liner material and a pressure sensitive adhesive therebetween;

b) the facer material having cut out a lower label section joined to an upper pull tab section with adjacent tab wings;

c) between the upper pull tab section and the tab wings are slits to assist in the beginning of the upper pull tab section tearing away from the tab wings when pulled while the tab wings remain on the packaging and the upper pull tab section remains intact with the lower label section;

d) the upper pull tab section has a liner material portion cut out to adhere to a back side of the upper pull tab section to assist the upper pull tab section from pulling off the packaging; and e) the lower label section and the adjacent tab wings have exposed adhesive upon the label being pulled off the liner material for use, wherein once the label is on the packaging the upper pull tab section may be pulled away from the packaging and torn away from the tab wings while remaining intact with the lower label section to indicate the package has been opened or otherwise tampered with;

wherein the label exists on a roll of material as one of a plurality of labels laterally staggered across a width of the roll.

9. The closure seal of claim 8, wherein the facer material comprises white polypropylene and the liner material comprises clear polyester.

10. The closure seal of claim 8, wherein the facer material has graphical indications to guide proper tearing of the upper pull tab section.

11. The closure seal of claim 8, wherein label indents are in the label between the upper pull tab section and the lower label section.

12. The closure seal of claim 8, wherein tab indents are between the top of the upper pull tab section and the adjacent tab wings for easy identifiable grasping of the upper pull tab section.

13. The closure seal of claim 8, wherein the roll of material is a roll of facer material, liner material and adhesive therebetween.

14. A closure seal pressure sensitive plastic label of a sandwich construction for use at the opening seam of packaging to be sealed to indicate whether the package has been opened or otherwise tampered with, comprising:

a) a facer material, a liner material and a pressure sensitive adhesive therebetween;

b) the facer material having cut out a lower label section joined to an upper pull tab section with adjacent tab wings, there being label indents between the upper pull tab section and the lower label section;

c) between the upper pull tab section and the tab wings are tab indents and slits to assist in the beginning of grasping the upper pull tab section and tearing the upper pull tab section away from the tab wings when pulled while the tab wings remain on the packaging and the upper pull tab section remains intact with the lower label section;

d) the upper pull tab section has a liner material portion cut out to adhere to a back side of the upper pull tab section to assist the upper pull tab section from pulling off the packaging; and e) the lower label section and the adjacent tab wings have exposed adhesive upon the label being pulled off the liner material for use, wherein once the label is on the packaging the upper pull tab section may be pulled away from the packaging and torn away from the tab wings while remaining intact with the lower label section to indicate the package has been opened or otherwise tampered with;

wherein the label exists on a roll of material as one of three or more labels laterally staggered across a width of the roll.

15. The closure seal of claim 14, wherein the facer material comprises white polypropylene and the liner material comprises clear polyester.

16. The closure seal of claim 14, wherein the facer material has graphical indications to guide proper tearing of the upper pull tab section and label placement during application to the packaging.

17. The closure seal of claim 14, wherein the roll of material is a roll of facer material, liner material and adhesive therebetween.

18. A closure seal pressure sensitive plastic label of a sandwich construction for use at the opening seam of packaging to be sealed to indicate whether the package has been opened or otherwise tampered with, comprising:

a) a facer material, a liner material and a pressure sensitive adhesive therebetween;

b) the facer material having cut out a lower label section joined to an upper pull tab section with adjacent tab wings, there being label indents between the upper pull tab section and the lower label section and the facer material having graphical indications to guide proper tearing of the upper pull tab section and label placement during application to the packaging;

c) between the upper pull tab section and the tab wings are tab indents and slits to assist in the beginning of grasping the upper pull tab section and tearing the upper pull tab section away from the tab wings when pulled while the tab wings remain on the packaging and the upper pull tab section remains intact with the lower label section;

d) the upper pull tab section has a liner material portion cut out to adhere to a back side of the upper pull tab section to assist the upper pull tab section from pulling off the packaging; and e) the lower label section and the adjacent tab wings have exposed adhesive upon the label being pulled off the liner material for use, wherein once the label is on the packaging the upper pull tab section may be pulled away from the packaging and torn away from the tab wings while remaining intact with the lower label section to indicate the package has been opened or otherwise tampered with;

wherein the label exists on a roll of material as one of six labels laterally staggered across a 12-inch width of the roll.

19. The closure seal of claim 18, wherein the facer material comprises white polypropylene and the liner material comprises clear polyester.

20. The closure seal of claim 18, wherein the roll of material is a roll of facer material, liner material and adhesive therebetween.

* * * * *